US005501340A

United States Patent [19]

Stafford

[11] Patent Number: 5,501,340

[45] Date of Patent: Mar. 26, 1996

[54] NON-SPILL LIQUID TOOTHPASTE DISPENSER

[76] Inventor: Bryan W. Stafford, 914 Knob Hill, Redondo Beach, Calif. 90277

[21] Appl. No.: 489,787

[22] Filed: Jun. 13, 1995

[51] Int. Cl.[6] ..... B65D 77/04

[52] U.S. Cl. ..... 206/361; 424/49

[58] Field of Search ..... 206/15.2, 15.3, 206/63.5, 277, 229, 581, 361, 362.2, 362.3; 424/49

[56] References Cited

U.S. PATENT DOCUMENTS

| | | | |
|---|---|---|---|
| 4,817,826 | 4/1989 | Judge | 206/277 |
| 4,978,003 | 12/1990 | Foster | 206/15.2 |
| 5,252,312 | 10/1993 | Gentile et al. | 424/49 |

FOREIGN PATENT DOCUMENTS

| | | | |
|---|---|---|---|
| 0576222 | 12/1993 | United Kingdom | 206/277 |

*Primary Examiner*—Paul T. Sewell
*Assistant Examiner*—Luan K. Bui
*Attorney, Agent, or Firm*—Monty Koslover Assoc.

[57] ABSTRACT

A non-spillable liquid toothpaste dispenser which stands upright for normal use, but can be used in any orientation. The dispenser is made of rigid plastic and comprises a case, a cap and a cartridge containing liquid toothpaste inside the case. Inside the top of the cartridge is a sliding valve having semicircular doors at its top. In use, a toothbrush head is pushed through a flanged hole in the top of the case, through the valve semicircular doors and into the liquid toothpaste. When the toothbrush is withdrawn, excess toothpaste is wiped off by the doors and the doors return to their normal closed position. The valve doors will also be made to close if any liquid toothpaste flows toward and impinges on the valve. In addition, a tight plug is provided in the cap to ensure no leakage of liquid when the dispenser is packed.

5 Claims, 3 Drawing Sheets

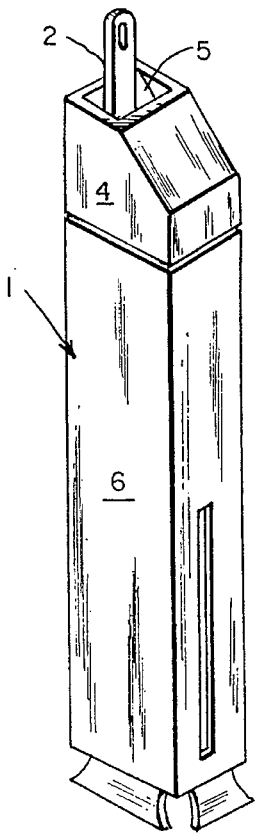
Fig. 1.
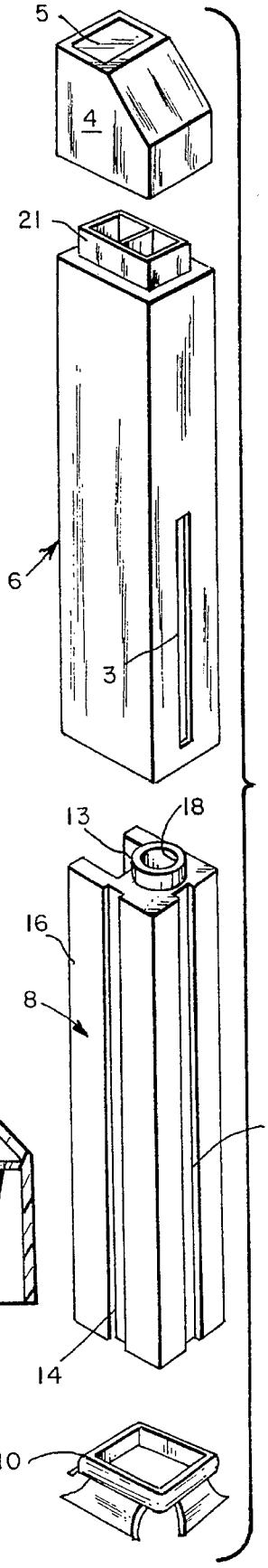
Fig. 2.
Fig. 3.
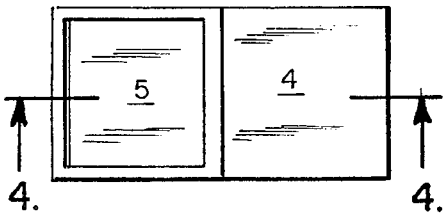
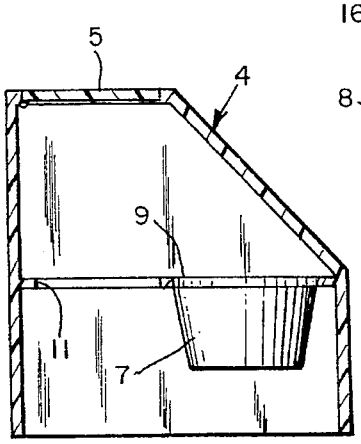
Fig. 4.
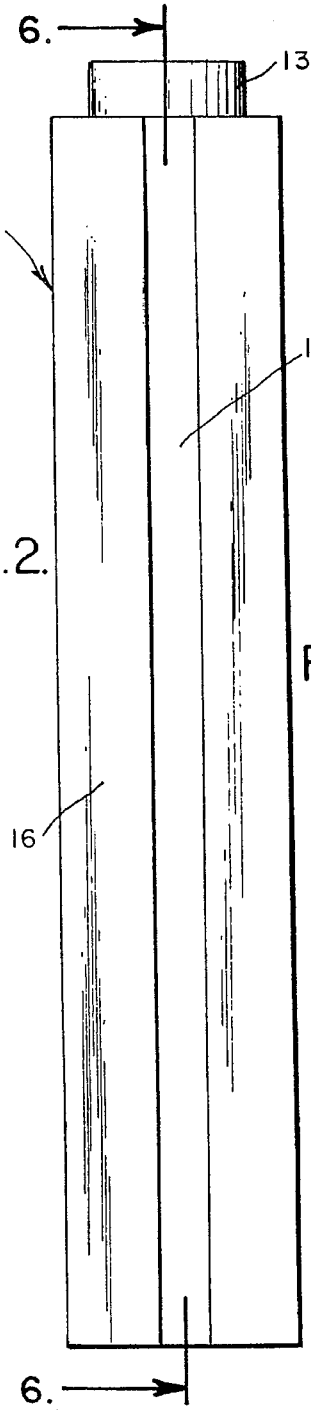
Fig. 5.

NON-SPILL LIQUID TOOTHPASTE DISPENSER

BACKGROUND OF THE INVENTION

1. Field of the Invention

This invention relates to toiletry devices and particularly to devices for dispensing toothpaste.

2. Background

Tooth cleaning materials are presently sold in three forms: powder, a cream paste and a liquid paste. The powder form is relatively old in origin and may use many different materials such as common house salt. A powder tooth cleaner material would most likely be dispensed from a box or metal can container.

Cream toothpastes vary according to their proprietary and patented compositions and are dispensed in a variety of containers such as squeeze tubes and pumps. They have also, in a number of patents, been contained in the handle of a toothbrush or in an attachment to a toothbrush, and are dispensed by mechanically activating release of the paste, which is forced into the head of the toothbrush.

Liquid toothpastes also vary according to their proprietary compositions as do cream toothpastes. However, liquid toothpastes have not been as convenient to transport and dispense as have cream toothpastes. They are typically sold in containers which must be kept upright when opened, to avoid spillage. Some liquid toothpastes are dispensed in pumps, similar to those used four dispensing hand soaps or creams. These pumped liquid toothpastes, while being more convenient to use than the simple container toothpastes, must have the pump head locked in place for packing in travel, and are generally not favored by those traveling by air because of probable leakage while airborne.

There is therefore a need for a non-spill liquid toothpaste dispenser that is suitable for travelers, particularly those who travel by air, and which will not leak fluid in any orientation. There is also a need for a refillable liquid toothpaste dispenser that looks good, stands upright and can be used easily anywhere.

SUMMARY OF THE INVENTION

The invention comprises four separate molded plastic components: a long rectangular section hollow body or case, a top cap which fits over the case top at one end, a long hollow cartridge containing liquid toothpaste that fits inside the case, and a case stand which fits into the bottom of the case, holding the cartridge in place. The top of the cartridge protrudes through an opening in the top of the case and the cartridge is provided with an opening and a novel sliding valve, through which the liquid toothpaste can be accessed. Provision is made for storing a toothbrush inside the case. In use, the device cap is removed and a toothbrush head is pushed through the sliding valve into the liquid toothpaste in the cartridge. When the toothbrush is pulled out, excess liquid is wiped off automatically and the valve closes, sealing in the liquid. A plug located inside the cap, mates with an opening in the cartridge top and provides additional liquid sealing.

The dispenser normally stands upright on its case stand legs. However, it can be used satisfactorily in any orientation. Refilling is done by either replacing the cartridge or by pouring from a liquid toothpaste supply through the valve in the cartridge top opening.

An invention advantage is that there is no likelihood and little possibility of liquid toothpaste leakage when the dispenser is packed and during air travel.

Another invention advantage is that the dispenser is easy to use and takes up little space on a bathroom counter.

Accordingly, it is a principal object of this invention to provide a liquid toothpaste dispenser that will not accidentally leak or spill liquid toothpaste in normal use or when placed in storage.

Another object is to provide a liquid toothpaste dispenser that is refillable and low in cost.

Further objects and advantages of the invention will be apparent from studying the following portion of the specification, the claims and the attached drawings.

BRIEF DESCRIPTION OF THE DRAWINGS

FIG. 1 is a front perspective view of the invention liquid toothpaste dispenser, particularly showing part of a toothbrush handle protruding as the toothbrush is being placed in a storage cavity in the dispenser;

FIG. 2 is an exploded view of the invention liquid toothpaste dispenser, showing in perspective the dispenser cap, the case, the cartridge and the bottom stand piece;

FIG. 3 is a plan view of the dispenser cap;

FIG. 4 is a side elevation cross-section view of the dispenser cap taken line 4—4 of FIG. 3, and particularly showing the location and shape of a plug which is used to seal the top of the cartridge;

FIG. 5 is a front elevation view of the cartridge;

DESCRIPTION OF THE PREFERRED EMBODIMENT

Figure 10:
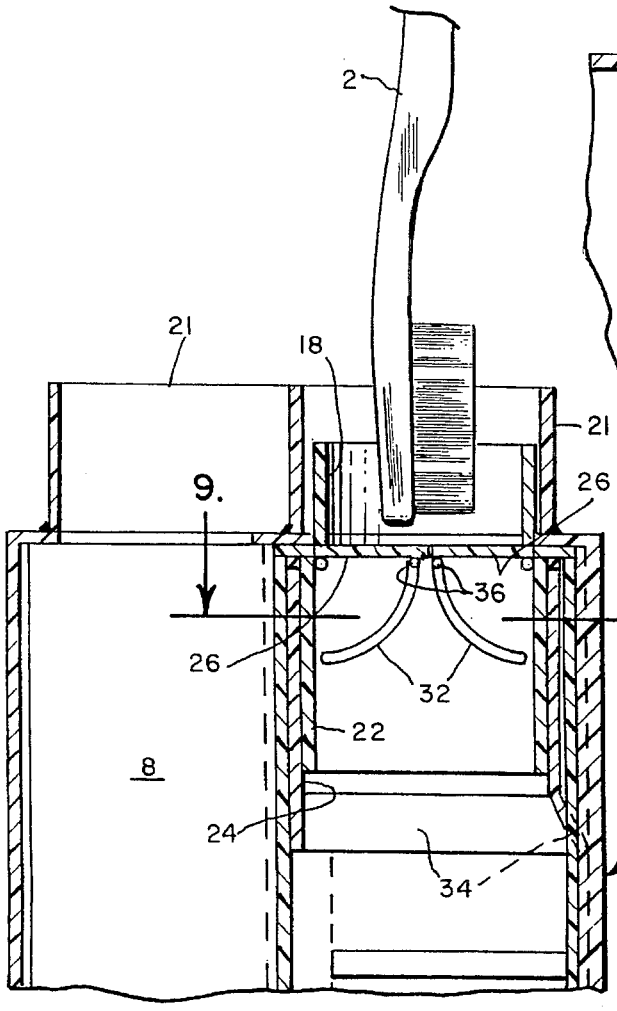
FIG. 10 is a partial, cross-section side elevation view of the assembled device, particularly showing how a toothbrush is to be inserted through the sliding valve doors and into the cartridge, the valve doors being closed.

Referring particularly to the drawings, there is shown in FIG. 1 a perspective view of a liquid toothpaste dispenser 1 according to the present invention. This dispenser 1 contains liquid toothpaste, provides convenient storage for a toothbrush and includes a valve preventing accidental spillage of the liquid toothpaste while in normal use or while the device is in storage.

Referring to FIG. 1, a toothbrush 2 is shown being either placed inside the dispenser 1 or being removed from the dispenser 1. A flap 5 in the dispenser cap 4 allows a toothbrush to be inserted in the dispenser for storage without removing the cap 4.

The four major parts of the dispenser assembly are shown in the exploded view of FIG. 2. These are, from the top down, a dispenser cap 4, a case 6, a cartridge 8, and the case stand 10. All the parts are made from molded plastic.

Figure 9:
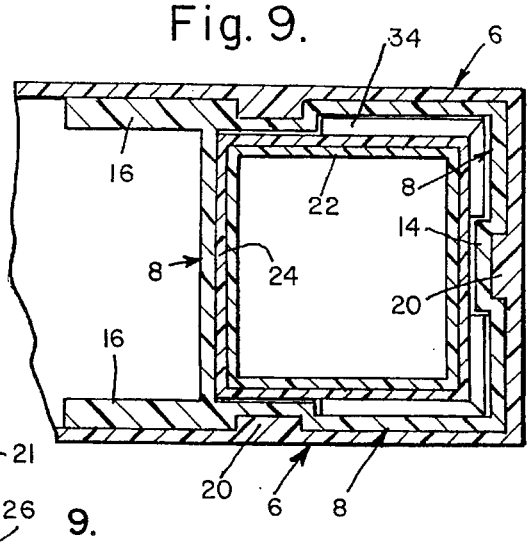
FIG. 9 is a partial, top cross-section view of the case and cartridge taken along line 9—9 of FIG. 10, and useful in explaining the nesting construction of the sliding valve inside the cartridge.
Figure 8:
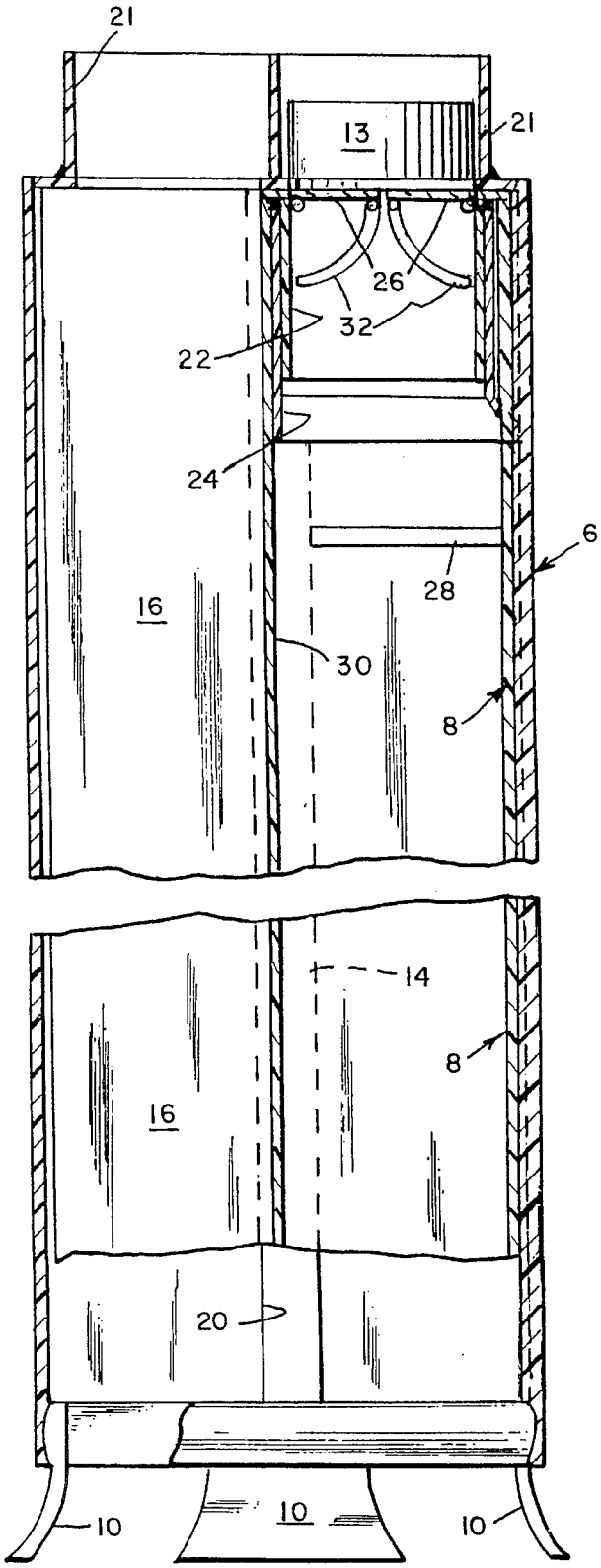
FIG. 8 is a partial, cross-section side elevation view of assembled device, without the dispenser cap, particularly showing the cartridge located inside the case and the cartridge valve mechanism.

The case 6 is an elongated, rectangular cross-section, four sided box which is open at both ends. At the top end, a stepped, flange projecting portion 21 narrows the opening and is divided it into two square openings. On the lower part of one of the case narrow sides, an elongated slot 3 is cut. This slot 3 is for the purpose of viewing the level of liquid toothpaste in the cartridge 8. Along the inside walls of the case are located raised splines. These splines 20, illustrated in FIGS. 8 and 9, are part of means for guiding and keying the cartridge 8 in place inside the case 6.

Refer to FIGS. 3 and 4 which are respectively a top plan view and a side elevation cross-section view of the dispenser cap 4. The cap 4 is a box having one open side which is shaped and sized to fit snugly over the top projecting portion 21 of the case 6. Inside the dispenser cap 4, across its lower portion, is a support shelf 9. In one part of the shelf 9, directly under the top flap 5 is a rectangular hole 11 which is about the same size as the flap 5. The rectangular hole allows a toothbrush to be passed through it. Suspended attached to the other half of the shelf 9 is a plug 7 which is located, shaped and sized to fit snugly into the ring shaped opening 18 portion of the cartridge 8, sealing it from leakage.

Figure 7:
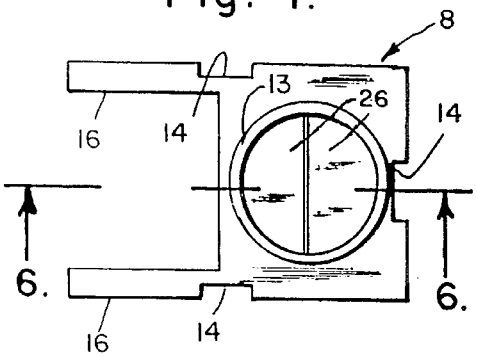
FIG. 7 is a top plan view of the cartridge, particularly showing the cartridge top opening and the valve doors inside the opening.
Figure 6:
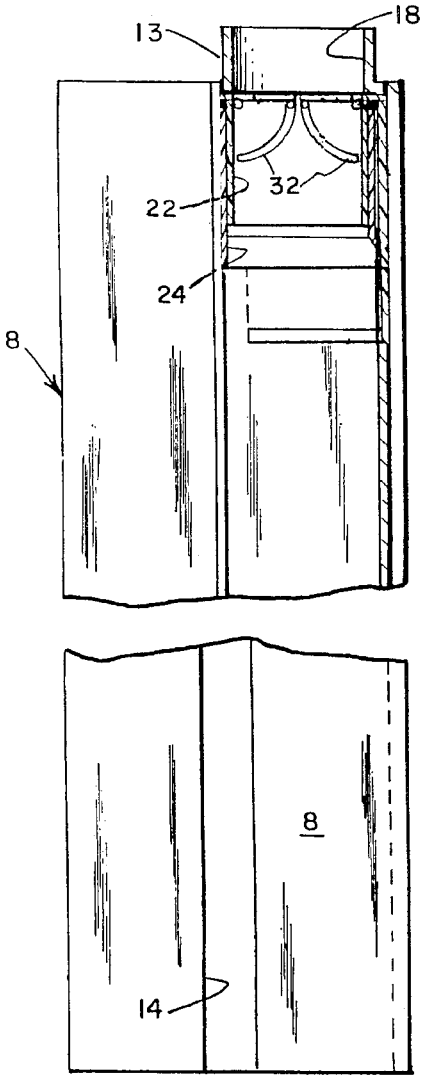
FIG. 6 is a partial, cross-section side elevation view of the cartridge taken along line 6—6 of FIG. 5 and FIG. 7, with the bottom portion of the Figure showing the outside surface and not in cross-section.

Refer now to FIGS. 2, 5, 6 and 7. FIG. 2 includes a front perspective view of the cartridge 8. FIG. 5 is a front elevation view of the cartridge 8, and FIGS. 6 and 7 are respectively, a side elevation cross-section view of the cartridge 8 taken along line 6—6 of FIGS. 5 and 7, and a top plan view of the cartridge 8.

Figure 11:
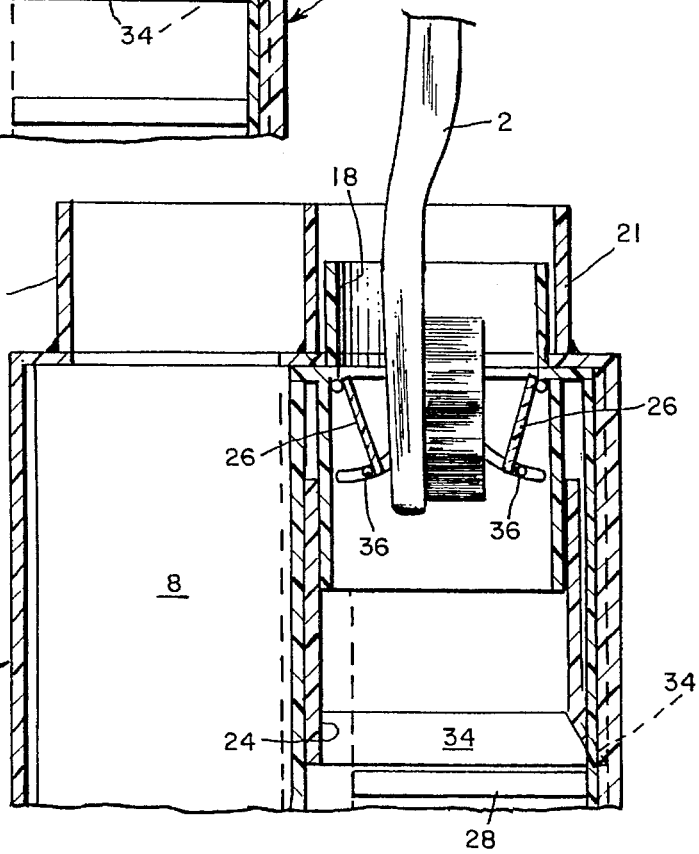
FIG. 11 is the a view of the invention device, according to FIG. 10, particularly showing how a toothbrush is inserted through the valve doors, with the valve doors pushed open and the valve slider portion pushed down by the doors.

The cartridge 8 is an elongated rectangular cross-section plastic block which is hollowed out to provide a cavity for containing liquid toothpaste, the bottom portion being solid. Two fin portions 16 extend from each end of one side, running the length of the cartridge block, and together with wide grooves 14 on three sides, serve to locate the cartridge 8 inside the case 6. The fin portions 16 are spaced apart enough to allow for storage of a toothbrush between them when the cartridge 8 is inside the case 6. At the top of the cartridge 8 is a raised ring portion 13. This ring portion 13 serves as the cartridge mouth and surrounds an orifice 18 which provides entry to the inside cavity of the cartridge. Valve doors 26 which prevent leakage of the liquid toothpaste are located inside the orifice 18 at the entrance to the cartridge cavity. The valve doors 26 are part of a valve assembly which includes a fixed support enclosure 22 that supports the valve doors 26, and a sleeve portion 24 that slides up and down outside the enclosure 22, allowing the doors to be opened and causing the doors 26 to close. Operation and the component parts of the valve means are fully described later herein and are illustrated by FIGS. 10 and 11.

Referring particularly to FIG. 5, the front groove 14 surface material is made transparent over most of its length in order to show the liquid toothpaste level in the cartridge 8, particularly when the level is low.

In assembly, the cartridge 8 is inserted in the bottom of the case 6 and is pushed up until the ring portion 13 fits through the top portion 21 of the case and the top shoulder of the cartridge bears against the case top inside surface. The case stand 10 is then pushed into the open bottom of the case 6 and snapped into place. This is depicted in FIG. 8, which is a partial cross-section view of the dispenser assembly without the dispenser cap 4.

Referring now to FIG. 8, the open space marked 16 on the left of the Figure is the space between the cartridge fins 16 which is available for storing a toothbrush. A cartridge wall 30 separates this storage space from the cartridge 8 internal cavity shown on the right of the Figure. A bar projection 28 is attached horizontally to the inside surface of the cartridge 8 side wall to act as a stop for the valve sleeve portion 24. Also shown in FIG. 8 is part of a spline 20 which runs vertically up the inside surface of the case 6 and mates with a groove 14 along the length of the cartridge 8 to guide the cartridge in place.

FIG. 9 is a partial cross-section view of the cartridge 8 fitted into the case 6, and is presented to further clarify how this is done. Referring to FIG. 9, it can be seen that the case 8 has three wide splines 20, one on each of three inside surfaces, to mate with three wide grooves 14 on the sides of the cartridge 8. The grooves 14 and splines 20 act to key the cartridge in place inside the case.

Inside the cartridge 8 cavity is shown the cross-section walls of the valve sleeve portion 24 and a top view of the flared portion 34 affixed to the sleeve which rides up and down against the inside surface of the case 8 walls. Nesting inside the valve sleeve portion 24 is the valve support enclosure 22.

Refer now to FIGS. 10 and 11 which are partial cross-section views of the dispenser assembly respectively with the valve doors 26 closed, and with the valve doors 26 being opened by insertion of a toothbrush 2.

The valve support enclosure 22 is a square plastic box open at its bottom end. The valve doors 26 are mounted to a circular hole in the enclosure 22 top wall which is fastened by adhesive to the top inside surface of the cartridge, fixing it in place immediately under the top opening 18 into the cartridge cavity.

The valve doors 26 are two halves of a plastic disk which pivot on a plastic hinge means at the door circumference attached to the top of the enclosure 22. Attached to the doors underside and along the straight edge of each door 26, is a plastic pin 36 which projects outward and through curved slots 32 which are cut into the support enclosure 22. The pin 36 ends protruding through the slots 32 bear on the top edge of the sleeve portion 24 which surrounds the support enclosure 22, pushing the sleeve portion 24 downwards when the doors 26 are pushed and rotated open as shown in FIG. 11.

The sleeve portion 24, which is a square, open box plastic construction, has attached to its bottom, a flared portion 34 which is sized outward to fill the space remaining between the sleeve outside surface and the inside walls of the cartridge. The flared portion 34 functions in the following manner: When the dispenser is turned at an angle so that the internal liquid toothpaste flows toward the top of the cartridge, the viscous liquid toothpaste flow will then impinge on the flared sleeve portion 34 and push the sleeve portion 24 upwards, closing the doors. In practice, the door 26 hinges have been found to be somewhat elastic, so that the doors will probably close even without being pushed to close by the sleeve portion 24.

Provision is made to prevent the sleeve portion 24 from sliding down too far. This is done using a small horizontal ridge 28 attached to an inside cartridge wall surface.

As described above, it can be seen that the valve is essentially simple, utilizing no springs and depending primarily on the elasticity of the plastic hinges, with a backup provided by a sliding sleeve actuated by liquid toothpaste flow. By itself, the valve door closure will prevent any leakage of the viscous liquid toothpaste enclosed in the cartridge and dispenser. However, the dispenser cap plug which mates with the top orifice of the cartridge provides further safety against leakage, making leakage under any circumstances highly unlikely.

The method of applying the toothpaste to the toothbrush is convenient to use. This is done by dipping a brush into the top of the dispenser and into the liquid pool, withdrawing the brush and having the valve doors wipe off the excess, with no drops spilled. This method avoids spillage as may occur with other conventional liquid toothpaste dispensers.

The dispenser is easily refillable, by either replacement of the cartridge or by refilling the cartridge from a liquid toothpaste supply. Finally, the dispenser is slim and can stand on a bathroom shelf, occupying little space and pleasing to look at.

From the above description, it is clear that the preferred embodiment achieves the objects of the present invention. Alternative embodiments and various modifications may be apparent to those skilled in the art. These alternatives and modifications are considered to be within the spirit and scope of the present invention.

Having described the invention, what is claimed is:

1. A liquid toothpaste dispenser device comprising in combination:

an elongated case made of rigid plastic, having a rectangular shape cross-section with two long sides being approximately twice the width of the two short sides, and fully open at one end of its length, designated the case bottom, and having a stepped flange projecting from the distal end of said case, said distal end designated the case top, said stepped flange being rectangular in plan shape, conforming to the surface shape of said case top and having a divider across the center of said flange, producing two approximately square openings that provide access to the interior portion of said case;

a cartridge made of molded, rigid plastic, having a rectangular cross-section shape and a length sized to fit snugly inside said case, said cartridge having a wide channel formed in approximately one half of the cartridge thickness and extending for the cartridge length, the two vertical wider sides of said cartridge extend as arms toward its rear, forming said channel, said channel opening being made wide enough to accommodate the width of a toothbrush;

said cartridge including a cavity formed inside its length for filling with liquid toothpaste and a projecting circular flange at the top of said cartridge, said circular flange having a circular opening communicating with said cavity;

said cartridge including means for a door access valve installed inside the top of said cartridge to prevent leakage of said liquid toothpaste from said cartridge, while permitting access by a toothbrush head to said liquid toothpaste when required;

means for keying and guiding said cartridge into said case;

a case stand, said stand made of rigid plastic and being a shallow open top rectangular box having four projecting pieces attached to the underside of said box around its periphery forming legs, the sides of said box being sized to fit snugly into the bottom opening of said case, thereby holding said cartridge in place inside said case and providing a vertical stand; and a dispenser cap made of rigid plastic, said cap being shaped to fit closely over the outside surface of said stepped flange on top of said case, said cap having a square, plastic-hinged flap located in its top surface to permit insertion of a toothbrush through said flap and into said case for storage; said cap including a plastic plug mounted inside and sized and located to fully engage the inside surface of said circular flange at the top of said cartridge when said cap is placed in position on top of said case; said cap, through said plug, providing an additional safety prevention of fluid leakage from said cartridge.

2. The device as recited in claim 1 wherein said means for keying and guiding said cartridge into said case includes a front vertical groove and two side vertical grooves cut in said cartridge cooperating with a front vertical spline and two side vertical splines formed on the inside surface walls of said case, each said groove and said spline being located and sized so that said cartridge can be keyed into said case and have sufficient clearance to be slidingly moved.

3. The device according to claim 2 wherein said front vertical groove in said cartridge is made of transparent material in the lower half of said groove in order to reveal the level of liquid toothpaste in said cartridge.

4. The device as recited in claim 1 wherein said case includes an elongated slot cut vertically in the surface of its front side, said slot being located to coincide with a transparent portion of the front side of said cartridge and thereby permitting a view of liquid toothpaste level inside said cartridge.

5. The device as recited in claim 1 wherein said means for a door access valve includes a sliding valve comprising:

a support enclosure, said support enclosure being a square plastic box open at its bottom end; the enclosure top having two semicircular doors cut in its center forming a circular opening, said doors being mounted on plastic hinges to said enclosure top at their peripheral edges; two opposing enclosure sides including two curved slots each in an arc of approximately 90 degrees, said slots being located to trace the motion of the extreme ends of the straight edges of said doors as the doors pivot open through a 90 degree arc; said doors including pins attached to the underside of their straight edges to protrude through said curved slots, projecting a little beyond the outer surface of said enclosure; said enclosure top being fastened by adhesive to the inside top surface of said cartridge; and a sleeve portion, said sleeve portion being a square plastic box open at both top and bottom ends and fitting slidingly over the sides of said support enclosure, said sleeve portion including a flared skirt portion attached to the bottom of three of the sleeve straight sides; said flared portion protruding to touch and be able to move up and down the inside wall surface of said cartridge; said doors opening inwards when pushed, and said pins on said doors bearing on the top edges of said sleeve portion, causing said sleeve portion to slide downwards; said liquid toothpaste inside said cartridge moving towards the cartridge top when said dispenser is tilted, and impinging on the flared skirt portion of said sleeve portion, causing said sleeve portion to move towards said cartridge top, thereby pushing said doors closed.

* * * * *